US010335335B2

(12) United States Patent
Ohno et al.

(10) Patent No.: US 10,335,335 B2
(45) Date of Patent: Jul. 2, 2019

(54) AIR MATTRESS FOR GATCH BED

(71) Applicant: PARAMOUNT BED CO., LTD., Tokyo (JP)

(72) Inventors: Kenta Ohno, Tokyo (JP); Atsushi Kato, Tokyo (JP); Tomokazu Tachikawa, Tokyo (JP)

(73) Assignee: Paramount Bed Co., Ltd., Tokyo (JP)

( * ) Notice: Subject to any disclaimer, the term of this patent is extended or adjusted under 35 U.S.C. 154(b) by 226 days.

(21) Appl. No.: 15/324,030

(22) PCT Filed: Jun. 29, 2015

(86) PCT No.: PCT/JP2015/068649
§ 371 (c)(1),
(2) Date: Jan. 5, 2017

(87) PCT Pub. No.: WO2016/009818
PCT Pub. Date: Jan. 21, 2016

(65) Prior Publication Data

US 2017/0202719 A1 Jul. 20, 2017

(30) Foreign Application Priority Data

Jul. 15, 2014 (JP) ..... 2014-145363

(51) Int. Cl.
*A61G 7/05* (2006.01)
*A47C 27/10* (2006.01)
(Continued)

(52) U.S. Cl.
CPC ..... *A61G 7/05776* (2013.01); *A47C 27/082* (2013.01); *A47C 27/083* (2013.01); *A47C 27/10* (2013.01)

(58) Field of Classification Search
CPC ..... A61G 7/05776; A47C 27/082; A47C 27/083; A47C 27/10
See application file for complete search history.

(56) References Cited

U.S. PATENT DOCUMENTS 9,114,084 B2 8/2015 Takeda et al.
2008/0201858 A1* 8/2008 Caminade ..... A61G 7/05776 5/713
(Continued)

FOREIGN PATENT DOCUMENTS

JP 3562940 B2 9/2004
JP 2010-268837 A 12/2010
(Continued)

OTHER PUBLICATIONS

International Search Report for corresponding International Application No. PCT/JP2015/068649 dated Sep. 29, 2015.

*Primary Examiner* — Eric J Kurilla
(74) *Attorney, Agent, or Firm* — Renner, Otto, Boisselle & Sklar, LLP

(57) ABSTRACT

For each air cell, air is supplied and discharged through one of three lines independent of one another, every third cell being connected to the common line. The control unit controls inflation and deflation of air cells in turn in such an alternate manner that first the pressure of air in the air cells on the first line is increased and decreased, secondly the pressure of air in the air cells on the second line is increased and decreased, then the pressure of air in the air cells on the third line is increased and decreased. Thereafter, when the back tilt angle of the back bottom has reached a predetermined angle or greater, the control unit increases the pressure of air cells whose pressure is being lowered at that moment so as to produce an inflated mode similar to that of the other air cells. Then, while the back bottom is being raised, the control unit performs an inflation and deflation control of individual lines alternately on a cycle shorter than that in a normal control mode. With this arrangement, it is possible to prevent shrinkage of the air mattress in the bed longitudinal direction, prevent the bed user from sliding on
(Continued)

the bed, and further prevent the bed user from getting bedsores.

15 Claims, 5 Drawing Sheets

(51) Int. Cl.
*A47C 27/08* (2006.01)
*A61G 7/057* (2006.01)

(56) References Cited

U.S. PATENT DOCUMENTS

2008/0235872 A1* 10/2008 Newkirk ..... A61G 7/018 5/600
2009/0100605 A1* 4/2009 Caminade ..... A61G 7/05776 5/713
2010/0212089 A1 8/2010 Kajiwara et al.
2011/0197366 A1* 8/2011 Lachenbruch ..... A61G 7/015 5/655.3
2013/0145558 A1* 6/2013 Bhai ..... A61G 7/015 5/710
2014/0223665 A1* 8/2014 Chapin ..... A47C 27/10 5/710
2015/0182400 A1* 7/2015 Meyer ..... A61G 7/018 5/710
2017/0056264 A1* 3/2017 Chapin ..... A61G 7/05776
2018/0098901 A1* 4/2018 Chiang ..... A61G 7/02

FOREIGN PATENT DOCUMENTS

JP 2011-160892 A 8/2011
JP 2012-029922 A 2/2012
JP 2014-046043 A 3/2014
WO WO 2009/044515 A1 4/2009

* cited by examiner

AIR MATTRESS FOR GATCH BED

TECHNICAL FIELD

The present invention relates to an air mattress for gatch bed, placed on a plurality of bottoms including a back bottom, a hip bottom and a leg bottom and the like arranged in the bed longitudinal direction to perform a back raising operation and the like, in particular relates to the air mattress for a gatch bed, formed of the plurality of air cells arranged in parallel in a bed longitudinal direction.

BACKGROUND ART

In the gatch bed having an air mattress, a back bottom 1*a*, hip bottom 1*b*, buttock bottom 1*c*, thigh bottom 1*d*, knee bottom 1*e*, leg bottom 1*f* are arranged in the longitudinal direction of the bed, as shown in FIG. 1. Of these bottoms, the back bottom 1*a*, thigh bottom 1*d* and leg bottom 1*d*, for example, can be adapted to move up and down to thereby raise the back of the bed user (a person lying on the bed) for easy reading and other purposes or lower the back and flatten the bed for easy sleeping, easy medical examination and other purposes.

Placed on these bottoms 1*a* to 1*f* is an air mattress 2. As shown in FIG. 2, this air mattress 2 is formed of a plurality of air cells 3 extending to the bed width direction and arranged in parallel in the bed longitudinal direction. Patent Document 1 discloses a gatch bed using this air mattress. Patent Document 2 discloses a gatch bed using a mattress having nonwoven fabric as its core.

Of those gatch beds, when the back bottom 1*a* is raised in a back raising operation, the undersurface of air mattress 2 in contact with the back bottom 1*a* and others and the top surface of air mattress 2 in contact with the bed user become different in length in the longitudinal direction of the bed. That is, in the process of the back bottom 1*a* being moved up from the horizontal position (tilted upward), the top surface of air mattress 2 that is in contact with the bed user becomes shrunken while the length of the undersurface of air mattress 2 will not change because it is in contact with the back bottom 1*a* and others.

Particularly, in the case of air mattress 2, there is a mode in which a plurality of air cells 3 are successively and repeatedly inflated and deflated to thereby prevent the bed user front getting bedsores on their skin. If a back-raising operation is actuated while this mode is ongoing, the pressure of some of air cells 3 is lowered because the pressure of air cells is repeatedly increased and decreased successively. Such air cells 3 with their pressure lowered become likely to shrink due to the bed user's weight. Further, the air cells 3 of high pressure tend to fail down due to the bed user's weight if the pressure of the adjacent air cells is low. In this way, when the back section of air mattress 2 is moved up for a back raising operation, the top surface of air mattress 2 contracts with respect to the bed longitudinal direction, and the total length of air mattress 2 becomes shorter.

PRIOR ART DOCUMENTS

Patent Documents

Patent Document 1:

Japanese Patent Application Laid-open No. 2014-46043

Patent Document 2:

Japanese Patent No. 3562940

SUMMARY OF THE INVENTION

Problems to be Solved by the Invention

As described above, the air mattress used for the conventional gatch bed shrinks in the bed longitudinal direction at the time of the back raising operation. This makes the bed user's body likely to move toward the foot side and/or sink into the air mattress 2. As a result, a strong shearing force acts on the skin of the mattress user, which may cause bedsores. Further, when the body of the bed user slides to the foot side, the caregiver has to move the bed user toward the head side, which increases the burden on the caregiver. This also poses the problem of shearing forces being applied to the skin of the bed user when the bed user's body is moved upstream.

The present invention has been devised in view of the above problems, it is therefore an object of the present invention to provide an air mattress for a gatch bed that can prevent shrink of the air mattress in the bed longitudinal direction, prevent the bed user from sliding on the bed and further prevent the bed user from getting bedsores.

Means for Solving the Problems

According to the present invention, an air mattress for a gatch bed, placed on a plurality of bottoms including a back bottom and used for the gatch bed that performs a back raising operation for raising the back bottom, comprises:

a plurality of air cells extending to a bed width direction and being arranged in parallel in a bed longitudinal direction;

an air supplying unit for performing supply and discharge of air for each of the air cells; and, a control unit that alternately inflates and deflates the air cells by successively increasing and decreasing a pressure of air to be supplied to each of the air cells, wherein the control unit monitors a back tilt angle of the back bottom, and when the back tilt angle has reached a predetermined angle or greater, increases a pressure of air cells whose pressure is being lowered at that moment so as to produce an inflated mode similar to that of the other air cells, the control unit either returns an operation to a normal inflating end deflating control in which each air cell is alternately and repeatedly inflated and deflated or shifts the operation to a constant pressure control in which no alternate inflation and deflation is performed, after cessation of a back bottom raising.

According to another aspect of the present invention, an air mattress for a gatch bed, placed on a plurality of bottoms including a back bottom and used for the gatch bed that performs a back raising operation for raising the back bottom, comprises:

a plurality of air cells extending to a bed width direction and being arranged in parallel in a bed longitudinal direction;

an air supplying unit for performing supply and discharge of air for each of the air cells; and, a control unit that alternately inflates and deflates the air cells by successively increasing and decreasing a pressure of air to be supplied to each of the air cells, wherein the control unit, when a command signal for starting an inflating mode is input, when a previously set pressure control mode is actuated in accordance with a bed posture, when it has reached a previously designated start time, or when a previously set period of time has lapsed from a reference time, increases a pressure of air cells whose pressure is being lowered at that moment so as to produce an inflated mode similar to that of the other air cells, and the control unit either returns an operation to a normal inflating and deflating control in which each air cell is alternately and repeatedly inflated and deflated or shifts the operation to a constant pressure control in which no alternate inflation and deflation is performed, when a command signal for ending the inflating mode is input, when the pressure control mode is ended in accordance with the bed posture, when it has reached a previously designated ending time, or when the previously set period of time has lapsed from the reference time.

According to still another aspect of the present invention, an air mattress for a gatch bed, placed on a plurality of bottoms including a back bottom and used for the gatch bed that performs a back raising operation for raising the back bottom, comprises:

a plurality of air cells extending to a bed width direction and being arranged in parallel in a bed longitudinal direction;

an air supplying unit for performing supply and discharge of air for each of the air cells; and, a control unit that alternately inflates and deflates the air cells by successively increasing and decreasing a pressure of air to be supplied to each of the air cells, wherein the control unit monitors a back tilt angle of the hack bottom, and, when the back tilt angle has reached a predetermined angle or greater, increases a pressure of air cells whose pressure is being lowered at that moment so as to produce an inflated mode similar to that of the other air cells, the control unit, thereafter, repeats controlling of alternate inflation and deflation of each air cell on a cycle shorter than that at the time of a normal inflating and deflating control, in a period in which the back bottom is being raised, and, the control unit either returns an operation to the normal inflating and deflating control in which each air cell is alternately and repeatedly inflated and deflated on a cycle for the normal control or shifts the operation to a constant pressure control in which no alternate inflation and deflation is performed, after cessation of the back bottom raising.

According to a further aspect of the present invention, an air mattress for a gatch bed, placed on a plurality of bottoms including a back bottom and used for the gatch bed that performs a back raising operation for raising the back bottom, comprises:

a plurality of air cells extending to a bed width direction and being arranged in parallel in a bed longitudinal direction;

an air supplying unit for performing supply and discharge of air for each of the air cells; and, a control unit that alternately inflates and deflates the air cells by successively increasing and decreasing the pressure of air to be supplied to each of the air cells, wherein the control unit, when a command signal for starting an inflating mode is input, when a previously set pressure control mode is actuated in accordance with a bed posture, when it has reached a previously designated start time, or when a previously set period of time has lapsed from a reference time, increases a pressure of air cells whose pressure is being lowered at that moment so as to produce an inflated mode similar to that of the other air cells, the control unit, thereafter, repeats controlling of alternate inflation and deflation of each air cell on a cycle shorter than that at the time of a normal inflating and deflating control, in a period in which the back bottom is being raised, and, the control unit either returns an operation to the normal inflating and deflating control in which each air cell is alternately and repeatedly inflated and deflated on a cycle for a normal control or shifts the operation to a constant pressure control in which no alternate inflation and deflation is performed, when a command signal for ending the inflating mode is input, when the pressure control mode is ended in accordance with a bed posture, when it has reached a previously designated ending time, or when a previously set period of time has lapsed from a reference time.

According to still a further aspect of the present invention, an air mattress for a gatch bed, placed on a plurality of bottoms including a back bettors and used for the gatch bed that performs a back raising operation for raising the back bottom, comprises:

a plurality of air cells extending to a bed width direction and being arranged in parallel in a bed longitudinal direction;

an air supplying unit having n (n is a natural number equal to or greater than 2) lines independent from each other for performing air supply and air discharge to the air cells, every n−1th air cells being connected to the common line; and, a control unit that alternately inflates and deflates each air cell by increasing and decreasing a pressure of air in n lines, in turn in such a manner as to increase and decrease an air pressure in one line, then increase and decrease air pressure in the next line, wherein the control unit monitors a back tilt angle of the back bottom, and, when the back tilt angle has reached a predetermined angle or greater, increases a pressure of air cells whose pressure is being lowered at that moment so as to produce an inflated mode similar to that of the other air cells, the control unit, thereafter, repeats controlling of alternate inflation and deflation of each line on a cycle shorter than that at the time of a normal inflating and deflating control, in a period in which the back bottom is being raised, and, the control unit either returns an operation to the normal inflating and deflating control in which each line is alternately and repeatedly inflated and deflated on a cycle for a normal control or shifts the operation to a constant pressure control in which no alternate inflation and deflation is performed, after cessation of the back bottom raising.

According to still another aspect of the present invention, an air mattress for a gatch bed, placed on a plurality of bottoms including a back bottom and used for the gatch bed that performs a back raising operation for raising the back bottom, comprises:

a plurality of air cells extending to a bed width direction and being arranged in parallel in a bed longitudinal direction;

an air supplying unit having n in is a natural number equal to or greater than 2) lines independent from each other for performing air supply and air discharge to the air cells, every n−1th air cells being connected to the common line; and, a control unit chat alternately inflates and deflates each air cell by increasing and decreasing a pressure of air in n lines, in turn in such a manner as to increase and decrease an air pressure in one line, then increase and decrease an air pressure in the next line, wherein the control unit, when a command signal for starting an inflating mode is input, when a previously set pressure control mode is actuated in accordance with a bed posture, when it has reached a previously designated start time, or when a previously set period of time has lapsed from a reference time, increases the pressure of air cells whose pressure is being lowered at that moment so as to produce an inflated mode similar to that of the other air cells, the control unit, thereafter, repeats controlling of alternate inflation and deflation of each air cell on a cycle shorter than that at the time of a normal inflating and deflating control, in a period in which the back bottom is being raised, and, the control emit either returns sin operation to the normal inflating and deflating control in which each line is alternately and repeatedly inflated and deflated on a cycle for a normal control or shifts the operation to a constant pressure control in which no alternate inflation and deflation is performed, when a command signal for ending the inflating mode is input, when the pressure control mode is ended in accordance with a bed posture, when it has reached a previously designated ending time, or when a previously set period of from a reference time.

Herein, in an operation in which alternate inflation and deflation control is performed on a cycle shorter than that at the time of normal inflating and deflating control, the air may be discharged from air cells at an air flow rate higher than that at the time of the normal inflating and deflating control.

Advantages of the Invention

According to the present invention, when a back raising operation in the gatch bed is operated, after start of the back raising operation (the back tilt angle has been equal to or greater than a predetermined angle), immediately, the air cells being deflated at that moment is inflated with the maximum pressure of inflating and deflating mode, to thereby make all the air cells inflated. Accordingly, even if an excessive stress from the reactive force from the back of the bed user at the start of the back raising operation is applied on the air cells being in the expanded mode and adjacent to the deflated air cells to compress and bring down the air cells being in the expanded mode, all the air cells come to the inflated mode immediately after start of the back raising operation. Therefore, the above-described shrinkage and fall of the air cells as well as shrinkage of the air mattress with respect to the bed longitudinal direction due to the shrinkage and the fail will not occur. Accordingly, it is also possible to prevent the bed user's body from sliding in the bed longitudinal direction. Further, as a result of reducing stress causing the bed user's body to slide, the risk of generating bedsores can be towered and early recovery from bedsores can be expected.

Since when back raising is being operated, alternate inflation and deflation of air cells is repeated on a cycle shorter than that at the time of the normal control, it is possible to further reliably prevent the bed user's body from sliding. That is, inflation of all the air cells after start of back raising can make the air mattress unlikely to shrink as a whole. Thanks to the geometrical relation of the bed at the time of back raising the undersurface of the air mattress 2 that is in contact with the bottoms of unvaried dimensions will not change its length in the longitudinal direction of the bed while the top surface of the air mattress 2 becomes shorter in the longitudinal direction of the bed. This will cause stress that slides the bed user on the back bottom to the foot side. To deal with this, the air pressure of air cells on one of the lines is reduced so as to temporarily lower the contact pressure of the body against the air mattress in the corresponding areas. As a result, thanks to the shrinkage of the top surface of the air mattress, the downward stress acting on the bed user from the air mattress is released. Thus, it is possible to prevent sliding of the body.

MODE FOR CARRYING OUT THE INVENTION

Figure 1:
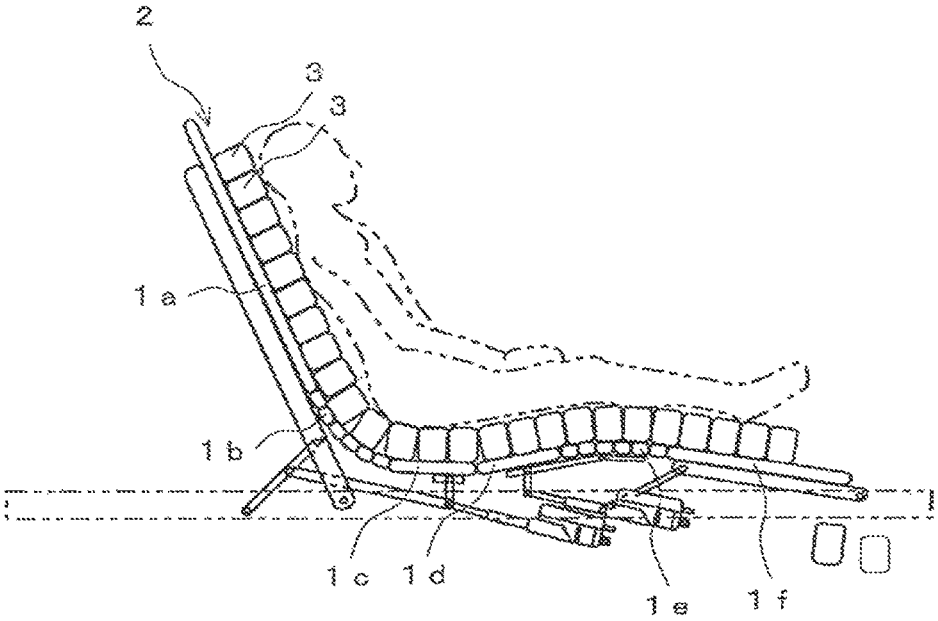
FIG. 1 A diagram showing a gatch bed using an air mattress of the embodiment of the present invention.
Figure 2:
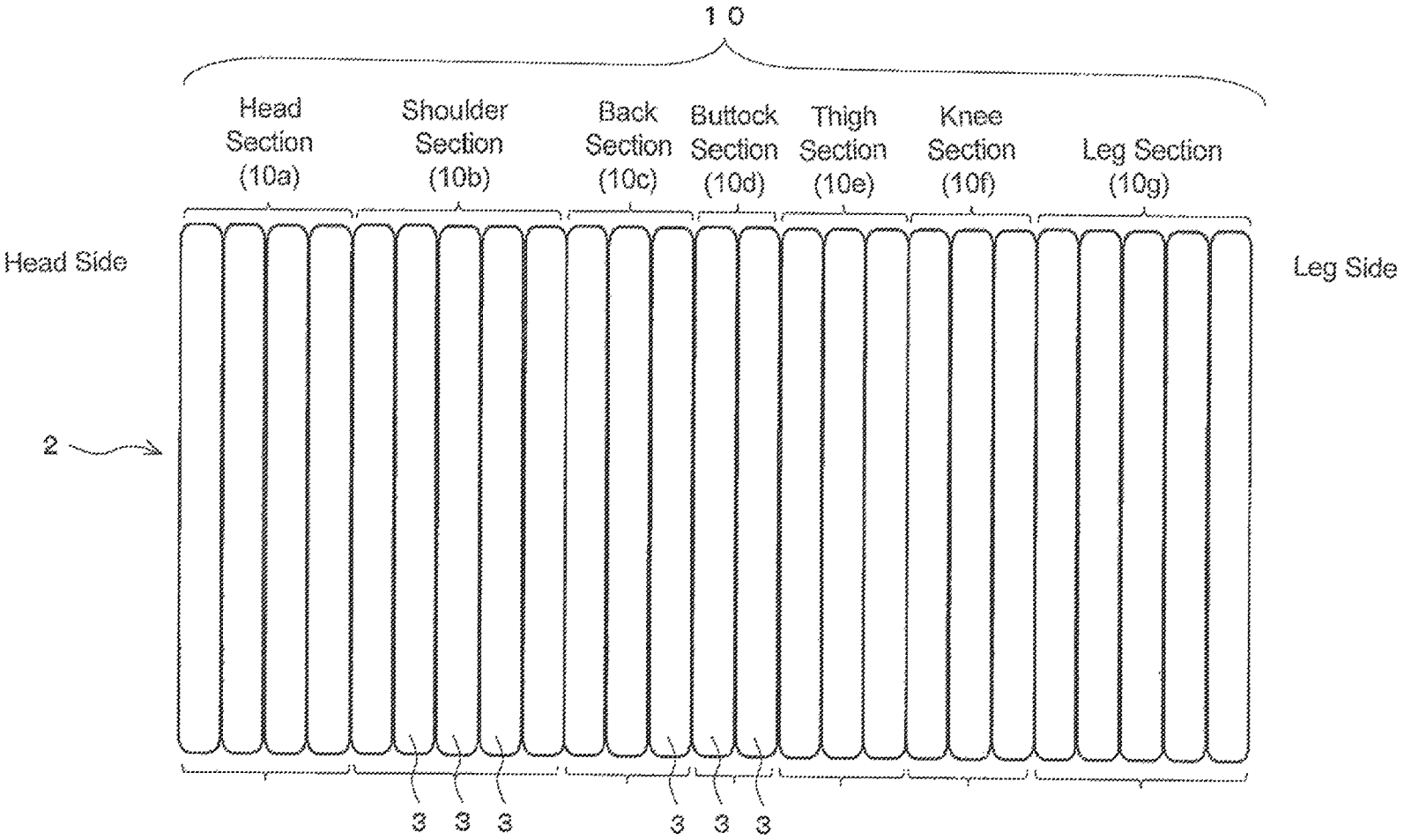
FIG. 2 A plan view showing the air mattress of the embodiment of the present invention.

Now, the embodiment of the present invention will be specifically described with reference to the accompanying drawings. As shown in FIGS. 1 and 2, the present embodiment is an air mattress 2 to be used for a gatch bed. In this gatch bed, a back bottom 1*a*, hip bottom 1*b*, buttock bottom 1*c*, thigh bottom 1*d*, knee bottom 1*e*, leg bottom 1*f* are arranged in the longitudinal direction of the bed. Of these bottoms, the back bottom 1*a*, thigh bottom 1*d* and leg bottom 1*f* can be rotated and moved by means of liking mechanisms and drive cylinders so as to cause the back bottom 1*a* to perform back-raising and back-lowering operation. The thigh bottom 1*d* and leg bottom 1*f* operate subordinately, following raising and lowering motion of the back bottom 1*a*.

Placed on these bottoms 1*a* to 1*f* is the air mattress 2. As shown in FIG. 2, this air mattress 2 is comprised of a plurality of air cells 3 extended across the bed width, juxtaposed in the longitudinal direction of the bed. Multiple air cells 3 are arranged in parallel from the head side to the leg side of the bed, correspondingly to each section of the bed user, i.e., head section 10*a*, shoulder section 10*b*, back section 10*c*, buttock section 10*d*, thigh section 10*e*, thigh section 10*e*, knee section 10*f* and leg section 10*g*.

Figure 3:
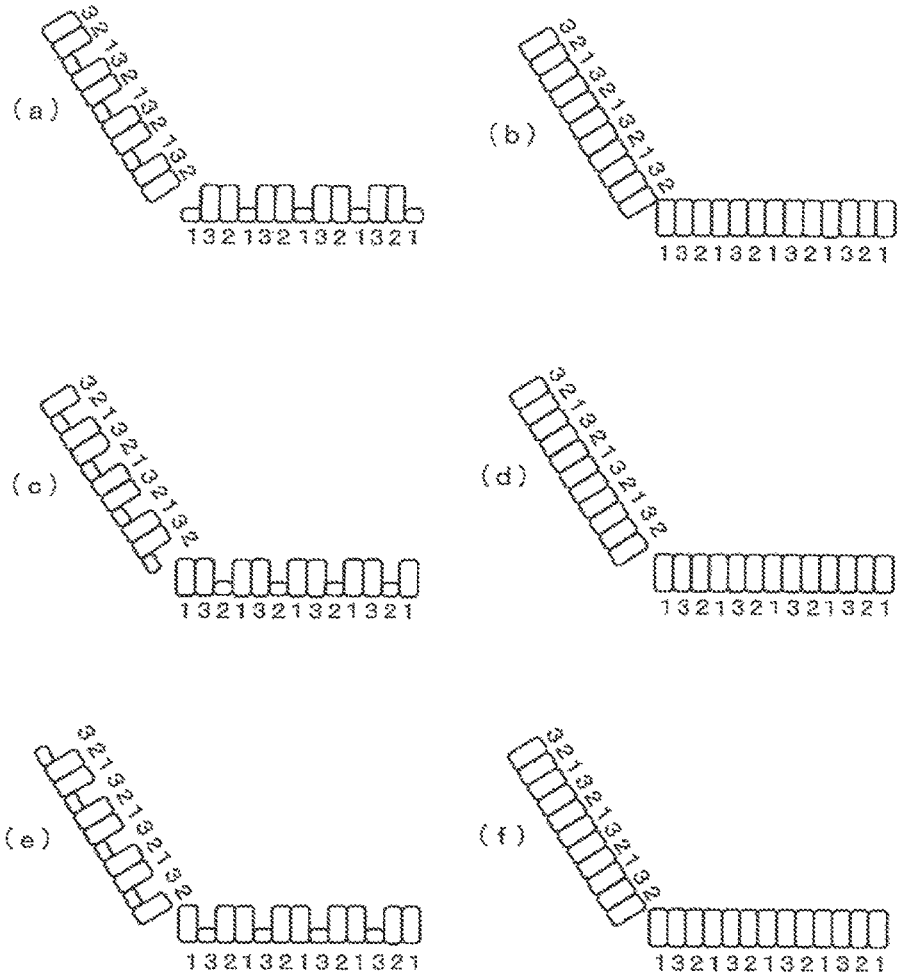
FIG. 3 A schematic diagram showing control modes of the embodiment of the present invention.

As shown in FIG. 3, individual air cells 3 are connected, in order from the leg side, to the pipes of the first line, the second line, the third line, the first line, second line, third line, . . . , and a control unit (not shown) controls each line to increase and decrease air pressure independently from the others. The numerals shown in FIG. 3 represent the line numbers. In this arrangement, at the time of normal pressure control the control unit increases the pressure of the air cells connected to the first line by supplying air and decreases the pressure by the following air discharge, then increases the pressure of the air cells connected to the second line by supplying air and decreases the pressure by the following air discharge. In this way, increase and decrease in pressure are successively done for each line. In this normal control, one cycle control of increasing and decreasing air pressure of the first line, increasing and decreasing air pressure of the second line, and increasing and decreasing air pressure of the third line is performed in 15 minutes for all the three lines, by allotting 5 minutes for each line, for example. In this way, in normal control, the air cells are inflated and deflated at a cycle of 15 minutes to thereby prevent the bed user from getting bedsores.

When a back raising operation is performed, the control unit first confirms that the back tilt angle has reached 20 degrees, for example. The back tilt angle may be determined by detecting the angle of the back bottom 1*a* from the horizontal by means of a sensor, or by calculation based on the advanced amount of the actuator (the moving length of the piston) or the like. When the control unit confirms that the back tilt angle of the back bottom 1*a* has reached a predetermined angle (e.g., 20°) and if the pressure of the air cell group connected to the first line is being lowered (in a shrunken state) at the movement as shown in FIG. 3(*a*), air is immediately supplied to the air cell group of the first line to inflate the air cell group of this first line as shown in FIG. 3(*b*). That is, the pressure of the 1st line air cell group is raised to the maximum of the inflation/deflation operation so as to coincide with the pressure of the other air cell groups of the second and third lines. As a result, all the air cells are inflated as shown in FIG. 3(*b*), thereby falling of air cells and shrinkage of the air mattress with respect to the bed longitudinal direction due to the back raising can be prevented and the bed user's body will not sink into the air mattress. Thus, it is possible to prevent the bed user from sliding in the Ned longitudinal direction, hence prevent getting or worsening bedsores.

Subsequently, the control unit controls inflation and deflation of each air cell in shorter cycles compared to those in normal control mode. For example, as to one cycle of inflation/deflation control for the first, second, and third lines, one cycle of the three lines as a whole is shortened to 3 minutes by allotting 1 minute, for each line so as to control inflation and deflation of air cells for each line in a markedly short cycle. Specifically, air is discharged from the air cells of the second line as shown in FIG. 3(*c*). Then, air is supplied to the same air cells of the second fine as shown in FIG. 3(*d*). This supply and discharge of air for the air cells of the second line is implemented in a short time. Thus, the contact pressure on the user's body is temporarily lowered by discharging air from the air cells of the second line in a short time so as to release downward stress of air mattress 2 on the bed user's body. Then, the pressure of the air mattresses of the second line is increased in a short time, whereby it is possible to prevent the adjacent air mattress from falling over the shrunk air mattress due to the weight of the bed user and prevent shrinkage of the air mattress. This inflation and deflation of the air cells at the time of back raising is effected at a speed as much as, for example, a series of inflation and deflation control for the second, third and first lines is done in three minutes.

In this case, the back raising period in which the back bottom 1*a* is tilted up in some tens seconds, e.g., 60 seconds. Accordingly, upon this back raising control, from when ail the air cells are inflated (FIG. 3(*b*)) after the back tilt angle reached 20° up to the end of the rising motion of the back tilt, inflation and deflation, of air cells is performed substantially for one line (FIG. 3(*c*) and FIG. 3(*d*)). That is, not for all the three lines but inflation and deflation is performed for one line only. This quick inflation and deflation makes it possible to release contact pressure of the air mattress acting on the back of the bed user, alleviate downward stress (toward the leg side) on the bed user's back at the time of back raising and hence prevent the bed user from sliding.

Thereafter, when the rising motion of the back bottom 1*a* is complete and the back bottom 1*a* is tilted up to the set angle, the control unit restarts normal inflating and deflating control for air cells. That is, the control unit effects inflation and deflation for the third line as shown in FIG. 3(*e*) and FIG. 3(*f*) and performs inflating and deflating control for the first to third lines in normal cycles. In this way, the bed user is prevented from getting bedsores.

As has been described, in the present embodiment, at the time of back raising, once all the air cells are inflated so as to prevent the air cells that have been repeatedly inflated and deflated, from falling down and shrinking, whereby it is possible to achieve a back raising operation without shrinkage of the air mattress as a whole. Thus, it is possible to prevent the bed user from sliding and getting bedsores. Further, since air is temporarily released from a part of the air cells at the time of back raising, downward force acting on the bed user based on the contact pressure of the air mattress is released so that it is possible to stretch the body of the bed user and prevent the bed user from being slid and getting bedsores in a further effective manner.

In the above embodiment, after cessation of the back bottom raising, the operation returns to the normal inflating and deflating control in which individual air cells are repeatedly controlled to inflate and deflate alternately. However, the present invention should not be limited to this. The operation after cessation of back bottom rising may be followed by constant pressure control without performing any alternate inflation and deflation.

In the above embodiment, the control unit is adapted to monitor the back tilt angle of the back bottom, and increase the pressure of air cells whose pressure is being lowered and produce an inflated mode similar to that for the other air cells when the back tilt angel becomes equal to or greater than a predetermined angle. However, the present invention should not be limited to this. The control unit may be adapted to increase the pressure of air cells whose pressure is being lowered and produce the inflated mode similar to that for the other air cells when a command signal for starting inflating mode is input, when a previously set pressure control mode is actuated in accordance with the bed posture, when it has reached a previously designated start time, or when a previously set period of time has lapsed from a reference time. Further, in the present embodiment, the operation is returned from the control in which individual air cells are alternately inflated and deflated, to the normal inflating and deflating control in which individual air cells are inflated and deflated in normal control cycles after cessation of the back bottom rising. However, the present invention should not be limited to this. It is possible to provide a configuration in which the operation is returned to the normal inflating and deflating control in which individual air cells are repeatedly controlled to inflate and deflate alternately when a command signal for ending the inflating mode is input, when the pressure control mode is ended in accordance with the bed posture, when it has reached a previously designated ending time, or when a previously set period of time has lapsed from a reference time. As described above, in the control configuration in which the pressure of the air cells whose pressure is lowered is increased to be set into the inflating mode similar to that for the other air cells in a period during which no back raising operation is operation, if a back pressure releasing operation command can be given when shearing stress has built up in the body without any back raising operation, it is possible to actuate the back pressure releasing operation at appropriate timing such as when the bed is moved, when the body position is changed, when diapers are changed and other occasions.

In the operation in which alternate inflation and deflation is repeatedly controlled on a shorter cycle than that in normal control mode, air may be discharged from the air cells at a greater floe rate man that in the normal control mode. The alternate inflating and deflating mode has periods for air supply, hold and air discharge. It is possible to sake the patient on the bed feel easy if the back pressure relieving is performed as soon as possible. Air discharge is a function that is normally used upon pressure adjustment. Since it becomes difficult to aim at a set value if air discharge is carried out at a high flow rate, air is discharged slowly. Specifically, the diameter of the flow channel of the air to be discharged is made smaller. However, since, at the time of alternate inflation and deflation, a pressure is simply lowered, it is possible to perform the back pressure relieving quickly by discharging air in the high flow rate (by selecting a large-diametric flow channel).

Here, the present invention should not be limited to the above embodiment, but various changes and modifications can be made. Connection of the air cells of the air mattress with the air supplying unit is not limited to the above embodiment using three hose lines, but various connection using two lines, four lines and others are possible. Though the back raising operation in the above embodiment is performed by inflating and deflating control based on a cycle shorter than that at the time of normal control, the back raising operation should not be limited to this, but air cells are not necessarily deflated in the back raising operation. Further, even if air cells are inflated and deflated at a high speed in the back raising operation, deflation of air cells may be performed multiple times not limited to one time. In the above embodiment, the cycle of inflation, and deflation for prevention of bedsores is 15 minutes=5 minutes×3 lines, for example, and the cycle of inflation and deflation in back raising is 3 minutes=1 minute×3 lines, for example. The cycle for this is not limited to the above, but various settings are possible.

Figure 4:
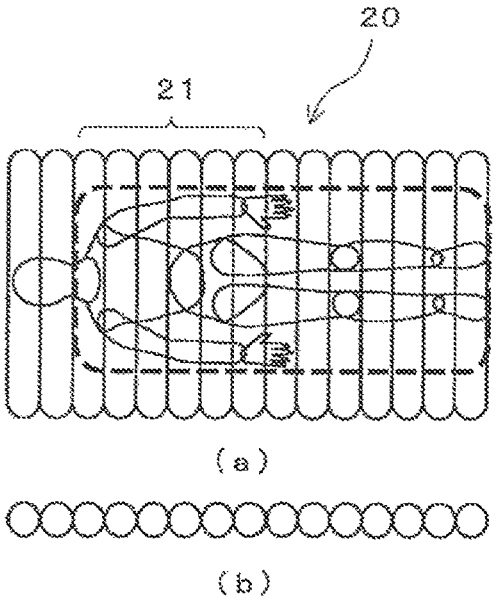
FIG. 4 (*a*) A plan view showing a layout example of air cells of the air mattress and (*b*) a side view of the same.
Figure 5:
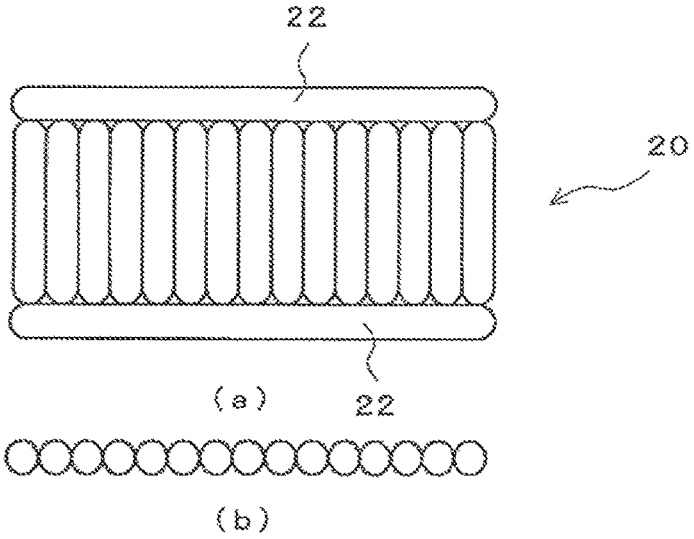
FIG. 5 (*a*) A plan view showing a layout example of air cells of the air mattress and (*b*) a side view of the same.
Figure 6:
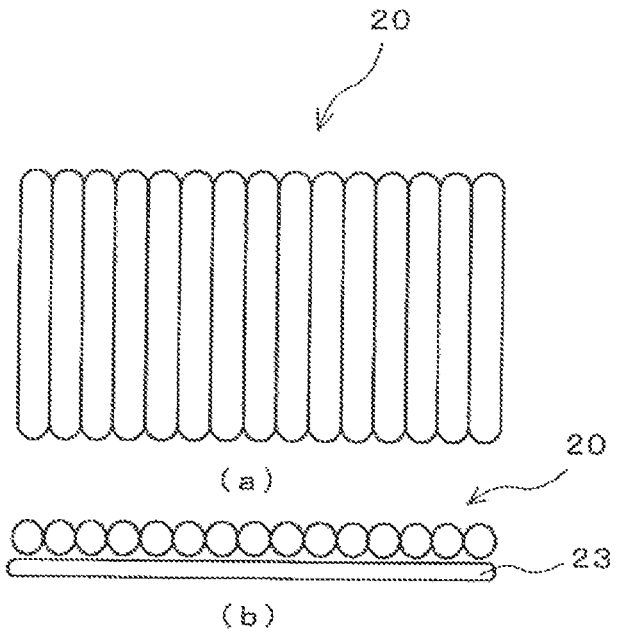
FIG. 6 (*a*) A plan view showing a layout example of air cells of the air mattress and (*b*) a side view of the same.
Figure 7:
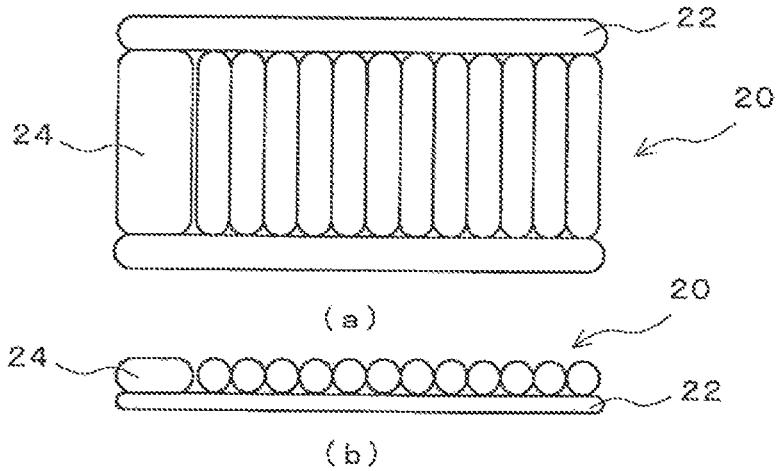
FIG. 7 (*a*) A plan view showing a layout example of air cells of the air mattress and (*b*) a side view of the same.

Further, the layout of air cells in the air mattress is not limited to that shown in FIG. 2. For example, a plurality of air cells 20 each have a bag-like form extended across the bed width direction and being arranged in parallel in the bed longitudinal direction as shown in FIG. 4. Of these, inflating and deflating air cells 21 need to be arranged in a range, at least, from the bed user's shoulder to the buttock while air cells in the other areas do not need to be able to be inflated and deflated. Further, as shown in FIG. 5, a pair of cushioning members 22 extending to the bed longitudinal direction may be arranged on both sides of air cells 20 with respect to the bed width direction. This cushioning members 22 may be an air cell or formed of a material such as urethane and the like. In this way, by pneumatically controlling both sides of the bed independently from the central part of the bed, for example, by adding air to the cushioning members 22 on both sides at high pressure, it is possible to prevent the patient from falling from the bed edge and improve stability of the patient when the patient sits at the edge. Further, as shown in FIG. 6, a sheet-like cushioning member 23 may be laid out under the air cells 20. This cushioning member 23 may use air cells, urethane or others. Thus, inflating the lower cushioning member 23 to high pressure or provision of a urethane layer as the cushioning member 23 can prevent the user from touching the bottom in a more reliable manner. Further, since the total amount of air for the entire air mattress can be reduced, it is possible to shorten the time for setup. It is also possible to arrange cushioning members 24 formed of air cells, urethane or any other having a greater cross section at one end or on both ends of the bed longitudinal direction, as shown in FIG. 7. In this way, it is possible to reduce the number of parts by replacing multiple air cells in the head part or leg part with the integrated air cell 24.

INDUSTRIAL APPLICABILITY

Upon back raising operation in the gatch bed, the air mattress for gatch bed of the present invention can prevent shrinkage of the air mattress in the longitudinal direction of the bed and prevent the bed user from sliding on the bed, further prevent the bed user from getting bedsores.

DESCRIPTION OF REFERENCE NUMERALS

1*a* to 1*f*: bottom
2: air mattress
3: air cell
20, 21: air cell
22, 23: cushioning member

The invention claimed is:

1. An air mattress placed on a plurality of bottoms including a back bottom, comprising:
- a plurality of air cells extending to a bed width direction and being arranged in parallel in a bed longitudinal direction;
- an air supplying unit for performing supply and discharge of air for each of the air cells; and,
- a control unit that inflates and deflates the air cells by increasing and decreasing a pressure of air to be supplied to each of the air cells, wherein
- the control unit is configured to:
  - detect a back tilt angle of the back bottom;
  - inflate an air cell, of the plurality of air cells, that is in a deflated state when the back tilt angle has reached a first angle; and
  - perform, after the air cell has been inflated, an inflating and deflating operation of a proper subset of the air cells until a rising operation of the back bottom ends.

2. The air mattress according to claim 1, wherein
- the inflating and deflating operation is repeated on a cycle shorter than that at the time of a normal inflating and deflating control.

3. The air mattress according to claim 2,
- wherein the air supplying unit performs air supply and air discharge to the air cells by n (n is a natural number equal to or greater than 2) lines independent from each other, every n−1th air cells being connected to a common line,
- the control unit alternately inflates and deflates each air cell by increasing and decreasing a pressure of air in n lines, in turn in such a manner as to increase and decrease an air pressure in one line, then increase and decrease air pressure in the next line, and
- the control unit performs controlling of alternate inflation and deflation by each line unit.

4. The air mattress according to claim 3, wherein in the operation in which the alternate inflation and deflation control is performed on the cycle shorter than that at the time of the normal inflating and deflating control, the air is discharged from air cells at an air flow rate higher than that at the time of the normal inflating and deflating control.

5. The air mattress according to claim 2, wherein in the operation in which the alternate inflation and deflation control is performed on the cycle shorter than that at the time of the normal inflating and deflating control, the air is discharged from air cells at an air flow rate higher than that at the time of the normal inflating and deflating control.

6. The air mattress according to claim 1,
- wherein the air supplying unit performs air supply and air discharge to the air cells by n (n is a natural number equal to or greater than 2) lines independent from each other, every n−1th air cells being connected to a common line.

7. The air mattress according to claim 6, wherein in the operation in which the alternate inflation and deflation control is performed on the cycle shorter than that at the time of the normal inflating and deflating control, the air is discharged from air cells at an air flow rate higher than that at the time of the normal inflating and deflating control.

8. The air mattress according to claim 1, wherein in the operation in which the alternate inflation and deflation control is performed on the cycle shorter than that at the time of the normal inflating and deflating control, the air is discharged from air cells at an air flow rate higher than that at the time of the normal inflating and deflating control.

9. The air mattress according to claim 1, wherein the inflating and deflating operation is performed on a cycle shorter than that at the time of a normal inflating and deflating.

10. The air mattress according to claim 1, wherein the air cells are divided into a plurality of air cell groups, the control unit is configured to perform, after the air cell has been inflated, the inflating and deflating operation of one air cell group among the air cells until the rising operation of the back bottom ends.

11. An air mattress for a gatch bed, that includes a back bottom and performs a back bottom raising operation for raising the back bottom, comprising:

a plurality of air cells extending to a bed width direction and being arranged in parallel in a bed longitudinal direction;

an air supplying unit for performing supply and discharge of air for each of the air cells; and, a control unit that alternately inflates and deflates the air cells by successively increasing and decreasing a pressure of air to be supplied to each of the air cells, wherein the control unit is configured to:

increase a pressure of an air cell that is in a deflated state so as to produce an inflated mode similar to that of the other air cells, in a front half period of the back bottom raising operation;

repeat controlling of alternate inflation and deflation of each air cell on a cycle shorter than that at the time of a normal inflating and deflating control, in a rear half of the back bottom raising operation; and either return an operation to a normal inflating and deflating control in which each air cell is alternately and repeatedly inflated and deflated or shift the operation to a constant pressure control in which no alternate inflation and deflation is performed, after cessation of the back bottom raising.

12. The air mattress according to claim 11, wherein the air supplying unit performs air supply and air discharge to the air cells by n (n is a natural number equal to or greater than 2) lines independent from each other, every n−1th air cells being connected to a common line; and, the control unit alternately inflates and deflates each air cell by increasing and decreasing a pressure of air in n lines, in turn in such a manner as to increase and decrease an air pressure in one line, then increase and decrease an air pressure in the next line.

13. The air mattress for gatch bed according to claim 12, wherein in the operation in which the alternate inflation and deflation control is performed on the cycle shorter than that at the time of the normal inflating and deflating control, the air is discharged from air cells at an air flow rate higher than that at the time of the normal inflating and deflating control.

14. The air mattress for gatch bed according to claim 11, wherein in the operation in which the alternate inflation and deflation control is performed on the cycle shorter than that at the time of the normal inflating and deflating control, the air is discharged from air cells at an air flow rate higher than that at the time of the normal inflating and deflating control.

15. An air mattress placed on a plurality of bottoms including a back bottom, comprising:

a plurality of air cells extending to a bed width direction and being arranged in parallel in a bed longitudinal direction;

an air supplying unit for performing supply and discharge of air for each of the air cells; and, a control unit that inflates and deflates the air cells by increasing and decreasing a pressure of air to be supplied to each of the air cells, wherein the control unit is configured to:

inflate an air cell that is in a deflated state when the back bottom begins to rise; and perform, after the air cell has been inflated, an inflating and deflating operation of a proper subset of the air cells until a rising operation of the back bottom ends.

* * * * *